US011242666B2

(12) United States Patent
Okada et al.

(10) Patent No.: US 11,242,666 B2
(45) Date of Patent: Feb. 8, 2022

(54) SHOVEL

(71) Applicant: SUMITOMO HEAVY INDUSTRIES, LTD., Tokyo (JP)

(72) Inventors: Junichi Okada, Kanagawa (JP); Kazunori Hiranuma, Kanagawa (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 317 days.

(21) Appl. No.: 16/357,784

(22) Filed: Mar. 19, 2019

(65) Prior Publication Data

US 2019/0211526 A1 Jul. 11, 2019

Related U.S. Application Data

(63) Continuation of application No. PCT/JP2017/034807, filed on Sep. 26, 2017.

(30) Foreign Application Priority Data

Sep. 30, 2016 (JP) ..... JP2016-194484

(51) Int. Cl.

| | |
|---|---|
| ***E02F 3/32*** | (2006.01) |
| ***E02F 9/26*** | (2006.01) |
| ***E02F 9/20*** | (2006.01) |
| ***E02F 9/22*** | (2006.01) |
| ***E02F 3/42*** | (2006.01) |

(52) U.S. Cl.

CPC ..... *E02F 3/32* (2013.01); *E02F 3/425* (2013.01); *E02F 9/2004* (2013.01); *E02F 9/2075* (2013.01); *E02F 9/2246* (2013.01); *E02F 9/262* (2013.01); *E02F 9/264* (2013.01)

(58) Field of Classification Search

CPC ... E02F 3/40; E02F 3/435; E02F 3/425; E02F 3/32; E02F 9/2029; E02F 9/226; E02F 9/2285; E02F 9/20; E02F 9/2004; E02F 9/2075; E02F 9/2246; E02F 9/2253; E02F 9/262; E02F 9/264; E02F 9/265; G05B 13/02

See application file for complete search history.

(56) References Cited

U.S. PATENT DOCUMENTS 7,691,686 B2 4/2010 Nishi et al.
8,620,533 B2 * 12/2013 Taylor ..... E02F 3/435 701/50

(Continued)

FOREIGN PATENT DOCUMENTS

JP 2014-064024 4/2014
JP 2014-122510 7/2014

(Continued)

OTHER PUBLICATIONS

International Search Report for PCT/JP2017/034807 dated Jan. 9, 2018.

*Primary Examiner* — Jessica H Lutz
(74) *Attorney, Agent, or Firm* — IPUSA, PLLC

(57) ABSTRACT

A shovel includes a traveling body, an upper turning body turnably provided on the traveling body, an attachment including a boom, an arm, and a bucket and attached to the upper turning body, and a processor. The processor is configured to correct the motion of the attachment in such a manner as to control a slip of the traveling body toward the back in the extension direction of the attachment.

9 Claims, 18 Drawing Sheets

(56) References Cited

U.S. PATENT DOCUMENTS

| | | | | |
|---|---|---|---|---|
| 9,127,434 | B2 | 9/2015 | Shiratani et al. | |
| 9,518,370 | B2 | 12/2016 | Tsukamoto | |
| 9,617,709 | B2 * | 4/2017 | Shintani | E02F 9/2004 |
| 10,161,111 | B2 * | 12/2018 | Iwanaga | G01S 19/43 |
| 10,633,824 | B2 * | 4/2020 | Bruyere | E02F 9/2221 |
| 10,669,696 | B2 * | 6/2020 | Takeda | E02F 9/22 |
| 10,954,651 | B2 * | 3/2021 | Hashimoto | E02F 3/847 |
| 2013/0081831 | A1 * | 4/2013 | Hayashi | E02F 3/847 172/4.5 |
| 2013/0085644 | A1 * | 4/2013 | Hayashi | E02F 3/847 701/50 |
| 2014/0343800 | A1 * | 11/2014 | Nelson | E02F 3/845 701/49 |
| 2015/0066312 | A1 * | 3/2015 | Sakuda | F15B 15/04 701/50 |
| 2015/0284930 | A1 | 10/2015 | Tsukamoto | |
| 2015/0284931 | A1 | 10/2015 | Tsukamoto | |
| 2018/0298584 | A1 | 10/2018 | Okada | |
| 2019/0085529 | A1 * | 3/2019 | Ishibashi | E02F 9/2037 |

FOREIGN PATENT DOCUMENTS

| | | |
|---|---|---|
| JP | 2014-163155 | 9/2014 |
| WO | 2014/097688 | 6/2014 |
| WO | 2014/097689 | 6/2014 |
| WO | 2017/104238 | 6/2017 |

* cited by examiner

SHOVEL

CROSS-REFERENCE TO RELATED APPLICATIONS

This application is a continuation application filed under 35 U.S.C. 111(a) claiming benefit under 35 U.S.C. 120 and 365(c) of PCT International Application No. PCT/JP2017/034807, filed on Sep. 26, 2017 and designating the U.S., which claims priority to Japanese patent application No. 2016-194484, filed on Sep. 30, 2016. The entire contents of the foregoing applications are incorporated herein by reference.

BACKGROUND

Technical Field

The present invention relates to shovels.

Description of Related Art

A shovel mainly includes a traveling body (also referred to as a crawler or lower frame), an upper turning body, and an attachment. The upper turning body is turnably attached to the traveling body, and has its position controlled by a turning motor. The attachment is attached to the upper turning body, and is used during work.

When the shovel is used in a brittle field of a low elastic modulus, such as on soft soil, or in a field of a low coefficient of friction, a slip of the shovel becomes a problem. For example, a technique to prevent a lift of the vehicle body of a shovel and a drag of the vehicle body of a shovel at the time of excavation has been disclosed. Furthermore, a technique regarding prevention of a slip of a traveling body at the time of turning has been disclosed. A technique to prevent a drag toward the front of a vehicle body (in a direction to approach an excavation point) by controlling the bottom pressure of an arm cylinder has been disclosed.

SUMMARY

According to an aspect of the present invention, a shovel includes a traveling body, an upper turning body turnably provided on the traveling body, an attachment including a boom, an arm, and a bucket and attached to the upper turning body, and a processor. The processor is configured to correct the motion of the attachment in such a manner as to control a slip of the traveling body toward the back in the extension direction of the attachment.

DETAILED DESCRIPTION

Figure 1:
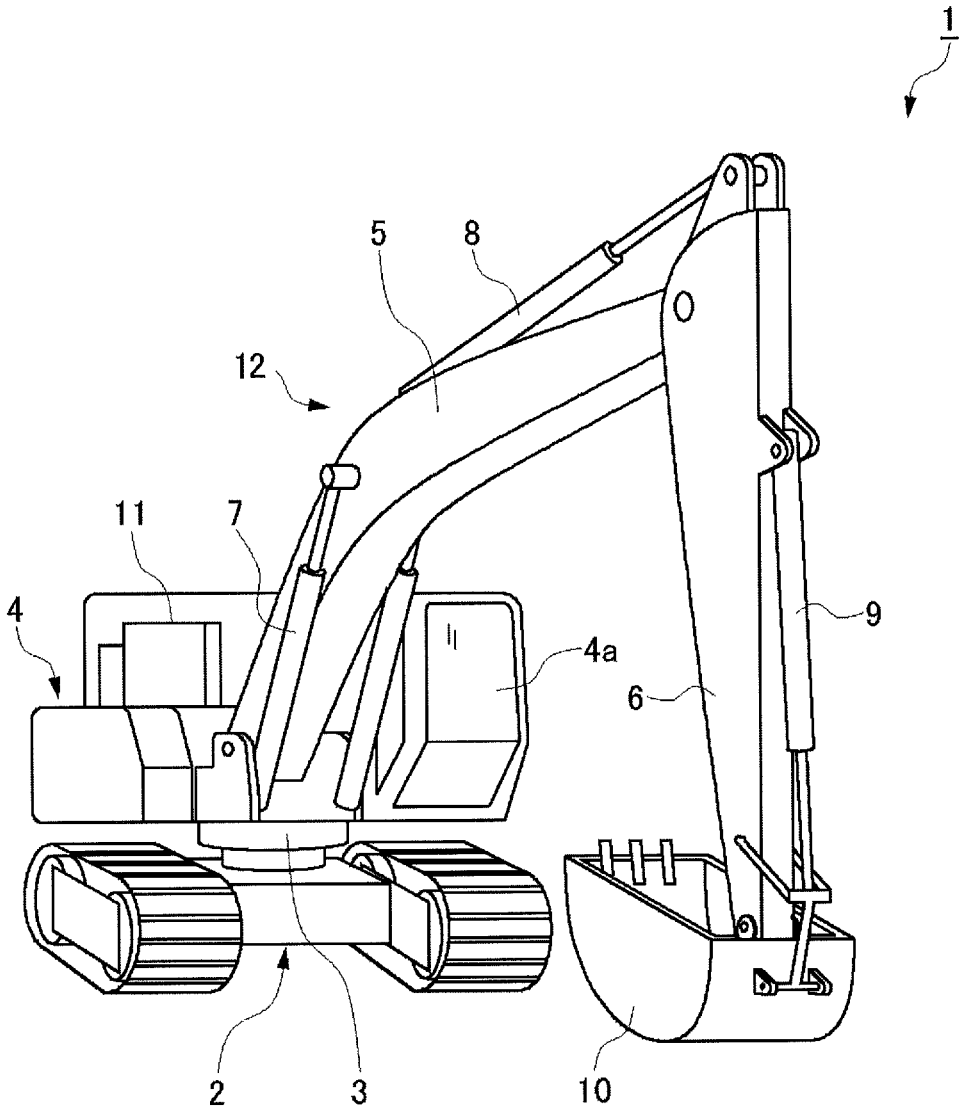
FIG. 1 is a perspective view illustrating an appearance of a shovel, which is an example of a construction machine according to an embodiment.

The inventors have studied shovels to recognize the following problem. Depending on the work condition of a shovel, a vehicle body may be dragged backward. A slip toward the back, which is outside the field of view of a worker (operator), makes the worker have psychological anxiety and reduces work efficiency, and may be more serious than a forward slip.

According to an aspect of the present invention, a shovel having a mechanism for controlling a backward slip due to a motion of an attachment is provided.

According to an aspect of the present invention, it is possible to control a slip of the traveling body of a shovel.

The present invention is described below with reference to the drawings based on an embodiment. The same or equivalent constituent elements, members, or processes are assigned the same reference numeral, and duplicate description is suitably omitted. An embodiment does not limit the invention and is an illustration. All features and their combinations described in an embodiment are not necessarily essential to the invention.

In the specification, "the state that a member A is connected to a member B" includes not only the case where the member A and the member B are physically directly connected but also the case where the member A and the member B are indirectly connected through another member that does not substantially affect their electrical connection or impair a function or effect achieved by their coupling.

FIG. 1 is a perspective view illustrating an appearance of a shovel 1, which is an example of a construction machine according to an embodiment. The shovel 1 mainly includes a traveling body (also referred to as a lower frame or crawler) 2 and an upper turning body 4 turnably mounted on top of the traveling body 2 through a turning apparatus 3.

An attachment 12 is attached to the upper turning body 4. As the attachment 12, a boom 5, an arm 6 connected to the end of the boom 5 by a link, and a bucket 10 connected to the end of the arm 6 by a link are attached. The bucket 10 is means for capturing earth and sand or a hung load of a steel material or the like. The boom 5, the arm 6, and the bucket 10 are hydraulically driven with a boom cylinder 7, an arm cylinder 8, and a bucket cylinder 9, respectively. Furthermore, a cab 4*a* for accommodating an operator (driver) who manipulates the position, magnetizing operation, and releasing operation of the bucket 10 and power sources such as an engine 11 for generating hydraulic pressure are provided on the upper turning body 4.

Next, a slip of the shovel 1 and its control are described in detail.

The control of a slip by the shovel 1 can be understood as relaxing a stiff attachment to prevent transmission of the reaction or force of the attachment to a vehicle body.

Figure 2A:
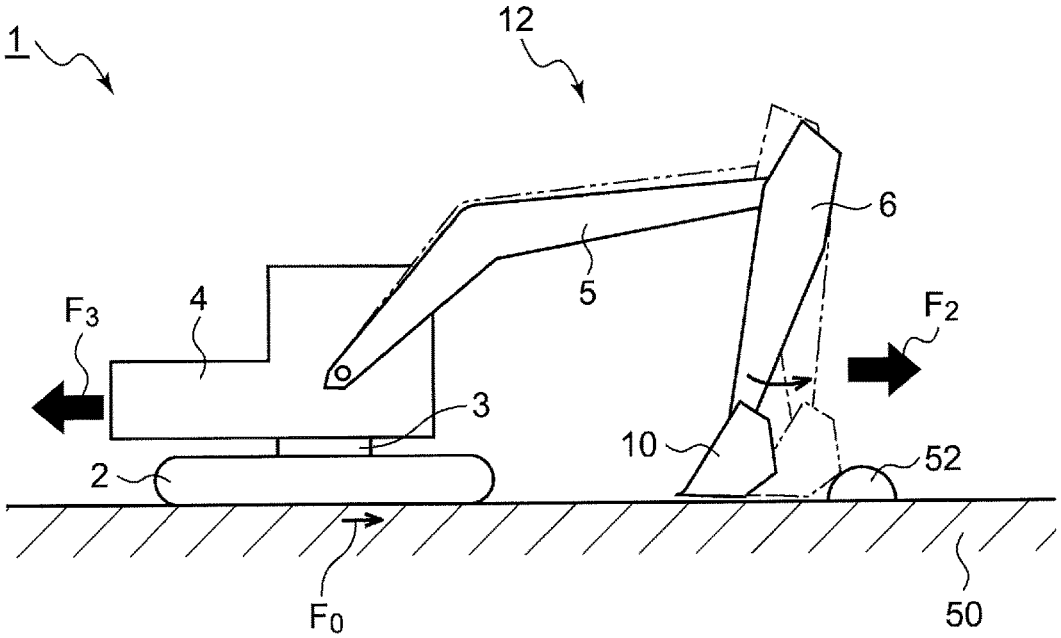
FIGS. 2A and 2B are diagrams illustrating specific examples of shovel work in which a backward slip occurs.
Figure 2B:
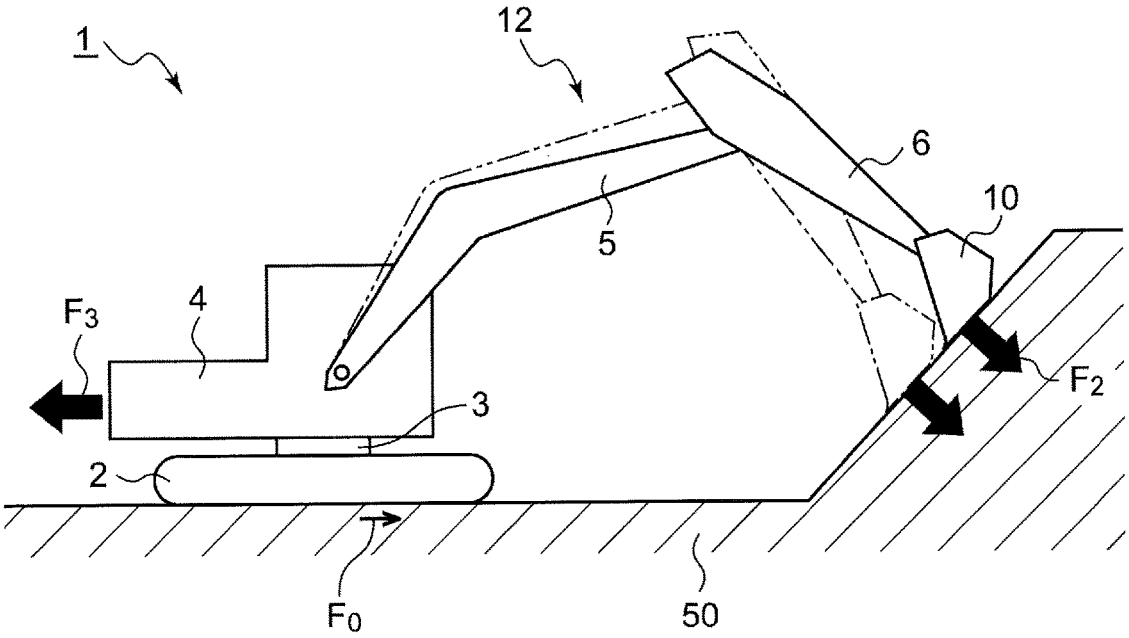

FIGS. 2A and 2B are diagrams illustrating specific examples of shovel work in which a backward slip occurs. The shovel 1 of FIG. 2A is leveling a ground 50, and a force $F_2$ is so generated as to cause the bucket 10 to push earth and sand 52 forward mainly by an arm opening motion. At this point, a reaction force $F_3$ from the attachment 12 acts on the vehicle body (the traveling body 2, the turning apparatus 3, and the turning body 4) of the shovel 1. When the reaction force $F_3$ exceeds a maximum static friction force $F_0$ between the shovel 1 and the ground 50, the vehicle body slips backward.

The shovel 1 of FIG. 2B is working on river construction, and is performing the work of pressing the bucket 10 against an inclined wall face mainly by an arm opening motion to solidify and level earth and sand. In this kind of work as well, a reaction force from the attachment 12 acts in a direction to slip the vehicle body backward.

Figure 3:
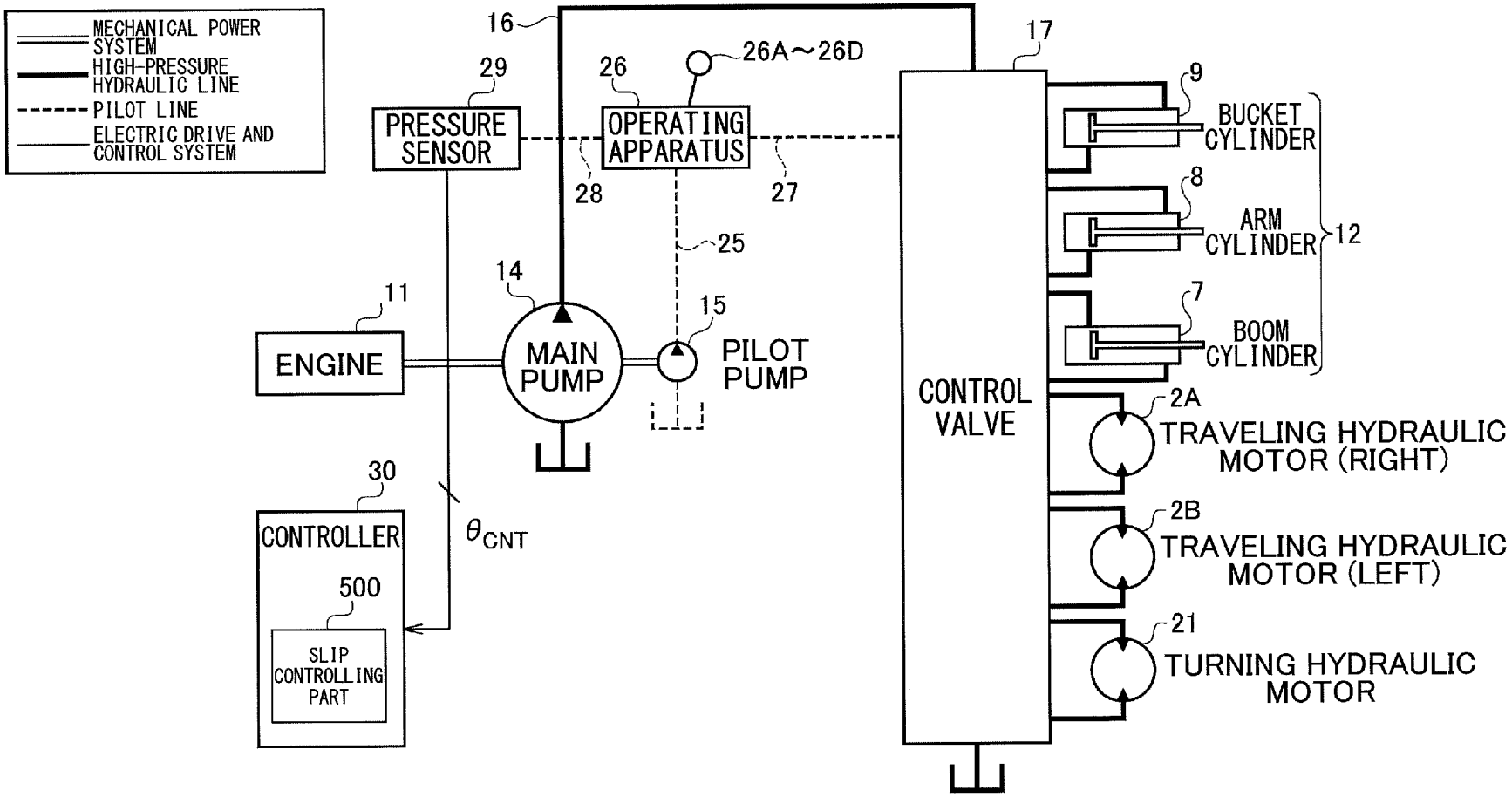
FIG. 3 is a block diagram of the electrical system and the hydraulic system of the shovel.

Next, a specific configuration of the shovel 1 that can control a backward slip is described. FIG. 3 is a block diagram of the electrical system and the hydraulic system of the shovel 1. In FIG. 3, a system that mechanically transmits power, a hydraulic system, an operating system, and an electrical system are indicated by a double line, a thick solid line, a dashed line, and a thin solid line, respectively. While a hydraulic shovel is discussed here, the present invention is also applicable to a hybrid shovel that uses an electric motor for turning.

The engine 11 is connected to a main pump 14 and a pilot pump 15. A control valve 17 is connected to the main pump 14 via a high-pressure hydraulic line 16. Two systems of hydraulic circuits may be provided to supply hydraulic pressure to hydraulic actuators. In this case, the main pump 14 includes two hydraulic pumps. For an easier understanding, the specification discusses the case of a single main pump system.

The control valve 17 is an apparatus that controls the hydraulic system of the shovel 1. In addition to traveling hydraulic motors 2A and 2B for driving the traveling body 2 illustrated in FIG. 1, the boom cylinder 7, the arm cylinder 8, and the bucket cylinder 9 are connected to the control valve 17 via high-pressure hydraulic lines. The control valve 17 controls hydraulic pressure (control pressure) to supply to these in accordance with an operator's operation input.

Furthermore, a turning hydraulic motor 21 for driving the turning apparatus 3 is connected to the control valve 17. While the turning hydraulic motor 21 is connected to the control valve 17 via the hydraulic circuit of a turning controller, the hydraulic circuit of the turning controller is not illustrated in FIG. 3 for simplification.

An operating apparatus 26 (an operating part) is connected to the pilot pump 15 via a pilot line 25. The operating apparatus 26, which is an operating part for operating the traveling body 2, the turning apparatus 3, the boom 5, the arm 6, and the bucket 10, is operated by the operator. The control valve 17 is connected to the operating apparatus 26 via a hydraulic line 27, and a pressure sensor 29 is connected to the operating apparatus 26 via a hydraulic line 28.

For example, the operating apparatus 26 includes hydraulic pilot type operating levers 26A through 26D. The operating levers 26A through 26D are operating levers corresponding to a boom axis, an arm axis, a bucket axis, and a turning axis, respectively. In practice, two operating levers are provided with two axes being assigned to the forward and backward directions and the left and right directions of one of the two operating levers and the remaining two axes being assigned to the forward and backward directions and the left and right directions of the other of the two operating levers. Furthermore, the operating apparatus 26 includes pedals for controlling a traveling axis.

The operating apparatus 26 converts hydraulic pressure (primary-side hydraulic pressure) supplied through the pilot line 25 into hydraulic pressure commensurate with the amount of operation of the operator (secondary-side hydraulic pressure) and outputs the converted hydraulic pressure. The secondary-side hydraulic pressure output from the operating apparatus 26 (control pressure) is supplied to the control valve 17 through the hydraulic line 27 and is detected by the pressure sensor 29. That is, the detection values of the pressure sensor 29 represent operation inputs $\theta_{CNT}$ of the operator to the operating levers 26A through 26D. While the hydraulic line 27 is drawn as a single line in FIG. 3, in practice, there are hydraulic lines for control command values for the left traveling hydraulic motor 2B, the right traveling hydraulic motor 2A, and the turning hydraulic motor 21.

A controller 30 is a main control part that controls the driving of the shovel. The controller 30, which is composed of a processing unit that includes a CPU (Central Processing Unit) and an internal memory, is implemented by the CPU executing a program for drive control loaded into the memory.

Furthermore, the shovel 1 includes a slip controlling part 500. The slip controlling part 500 corrects the motion of the boom cylinder 7 of the attachment 12 such that a slip of the traveling body 2 toward the back in the extension direction of the attachment 12 is controlled. A main part of the slip controlling part 500 may be configured as part of the controller 30.

Figure 4:
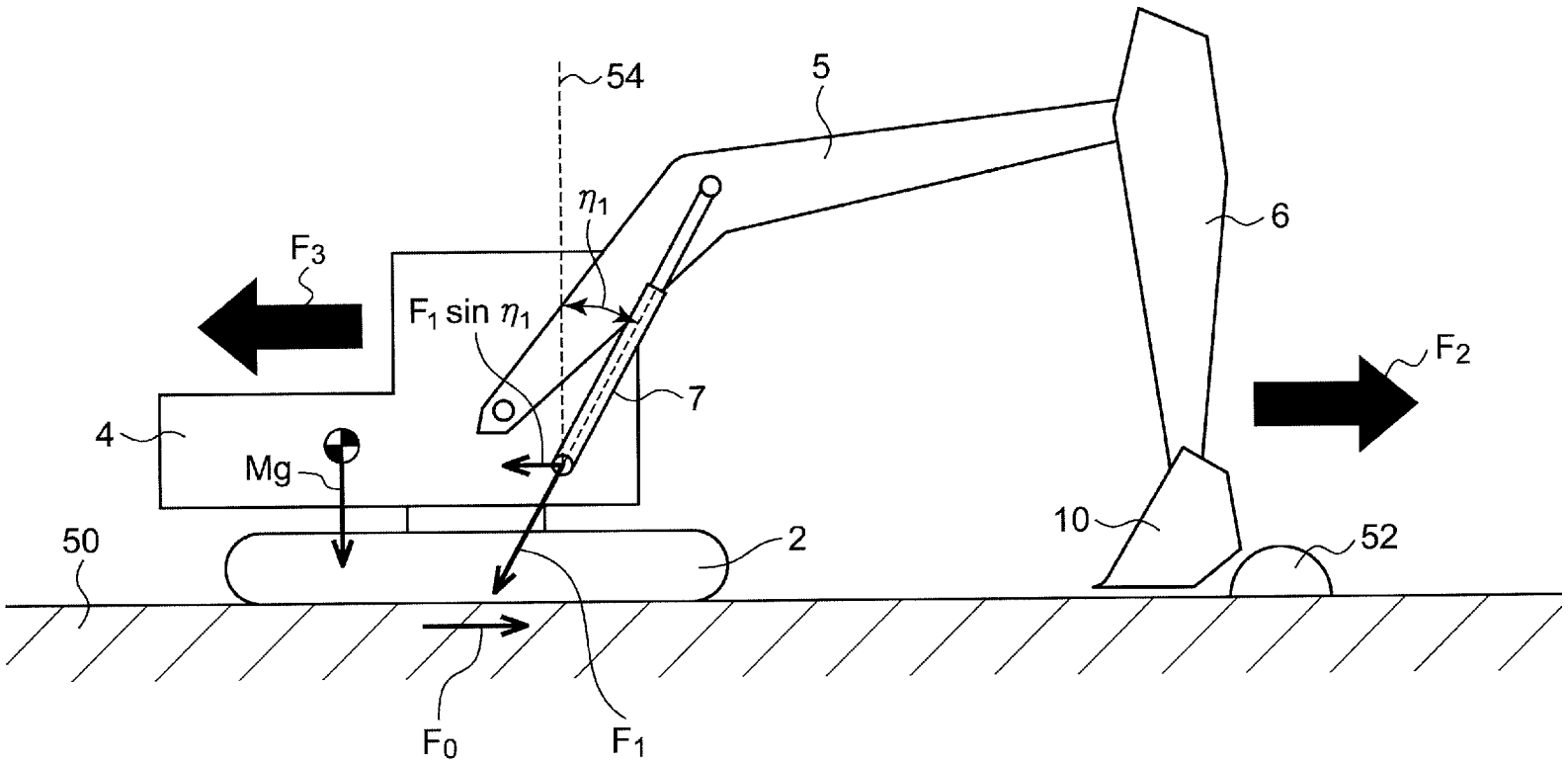
FIG. 4 is a diagram illustrating a mechanical model of a shovel regarding a backward slip.

FIG. 4 is a diagram illustrating a mechanical model of a shovel regarding a backward slip.

Letting an angle formed by the boom cylinder 7 and a vertical axis 54 be $\eta_1$ and letting a force exerted by the boom cylinder 7 on the upper turning body 4 be $F_1$, the force $F_3$ by which the boom cylinder 7 horizontally pushes the turning body 4 is given by:

$$F_3=F_1 \sin \eta_1 \tag{1}$$

Letting a coefficient of static friction between the traveling body 2 and the ground 50 be $\mu$, letting the weight of the vehicle body be M, and letting gravitational acceleration be g, the maximum static friction force $F_0$ is $\mu Mg$:

$$F_0=\mu Mg. \tag{2}$$

A condition under which the shovel 1 does not slip is:

$$F_3<F_0. \tag{3}$$

By plugging Eqs. (1) and (2) thereinto, a relational expression (4) is obtained:

$$F_1 \sin \eta_1<\mu Mg. \tag{4}$$

That is, the slip controlling part 500 of FIG. 3 may correct the motion of the boom cylinder 7 such that the relational expression (4) holds.

First Example Configuration

Figure 5:
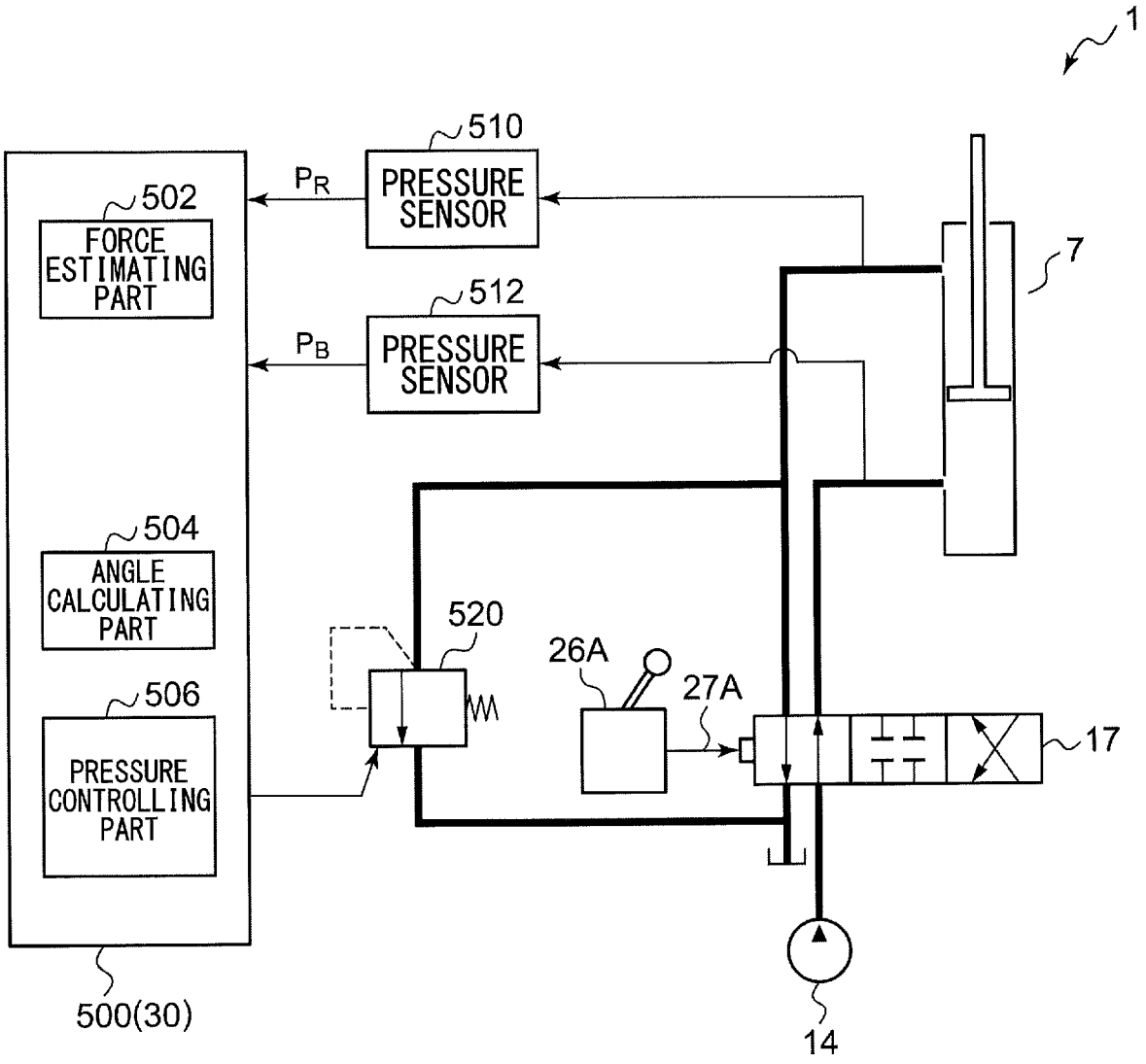
FIG. 5 is a block diagram of a slip controlling part of the shovel and its periphery according to a first example configuration.

FIG. 5 is a block diagram of the slip controlling part 500 of the shovel 1 and its periphery according to a first example configuration. Pressure sensors 510 and 512 measure the pressure of the rod-side oil chamber (rod pressure) $P_R$ and the pressure of the bottom-side oil chamber (bottom pressure) $P_B$, respectively, of the boom cylinder 7. The measured pressures $P_R$ and $P_B$ are input to the slip controlling part 500 (the controller 30).

The slip controlling part 500 includes a force estimating part 502, an angle calculating part 504, and a pressure controlling part 506.

The force $F_1$ is expressed by a function $f(P_R, P_B)$ of the pressures $P_R$ and $P_B$:

$$F_1=f(P_R,P_B). \tag{5}$$

The force estimating part 502 calculates the force $F_1$ exerted on the turning body 4 by the boom cylinder 7, based on the rod pressure $P_R$ and the bottom pressure $P_B$.

By way of example, letting a rod-side pressure receiving area and a bottom-side pressure receiving area be $A_R$ and $A_B$, respectively, $F_1$ can be expressed as $F_1=A_R \cdot P_R - A_B \cdot P_B$. The force estimating part 502 may calculate or estimate the force $F_1$ based on this equation.

The angle calculating part 504 calculates the angle $\eta_1$ formed by the vertical axis 54 and the boom cylinder 7. The angle $\eta_1$ may be geometrically calculated from the extension length of the boom cylinder 7, the size of the shovel 1, the tilt of the vehicle body of the shovel 1, etc. Alternatively, a sensor for measuring the angle $\eta_1$ may be provided, and the output of the sensor may be used. The coefficient of static friction μ may employ a typical predetermined value or may be input by an operator in accordance with the ground conditions of a work site.

Alternatively, the shovel 1 may be provided with a part that estimates the coefficient of static friction p. When a slip of the vehicle body is detected during work with the attachment 12 with the shovel 1 being stationary relative to the ground, p may be calculated from the force $F_1$ of the instant. For example, a slip may be detected by installing an acceleration sensor or velocity sensor on the upper turning body 4 of the shovel 1.

The pressure controlling part 506 controls the pressure of the boom cylinder 7 based on the force $F_1$ and the angle $\eta_1$ such that the expression (4) holds. According to this example configuration, the pressure controlling part 506 controls the rod pressure $P_R$ of the boom cylinder 7 such that the expression (4) holds.

A solenoid proportional relief valve 520 is provided between the rod-side oil chamber of the boom cylinder 7 and a tank. The pressure controlling part 506 controls the solenoid proportional relief valve 520 to relieve the cylinder pressure of the boom cylinder 7 such that the expression (4) holds. As a result, the rod pressure $P_R$ decreases to reduce $F_1$, so that it is possible to control a slip.

The state of a spool of the control valve 17 for controlling the boom cylinder 7, namely, the direction of hydraulic oil supplied from the main pump 14 to the boom cylinder 7, is not limited in particular, and may be a reverse direction or blocked instead of a forward direction as in FIG. 5, depending on the condition of the attachment 12 (the contents of work).

Second Example Configuration

Figure 6:
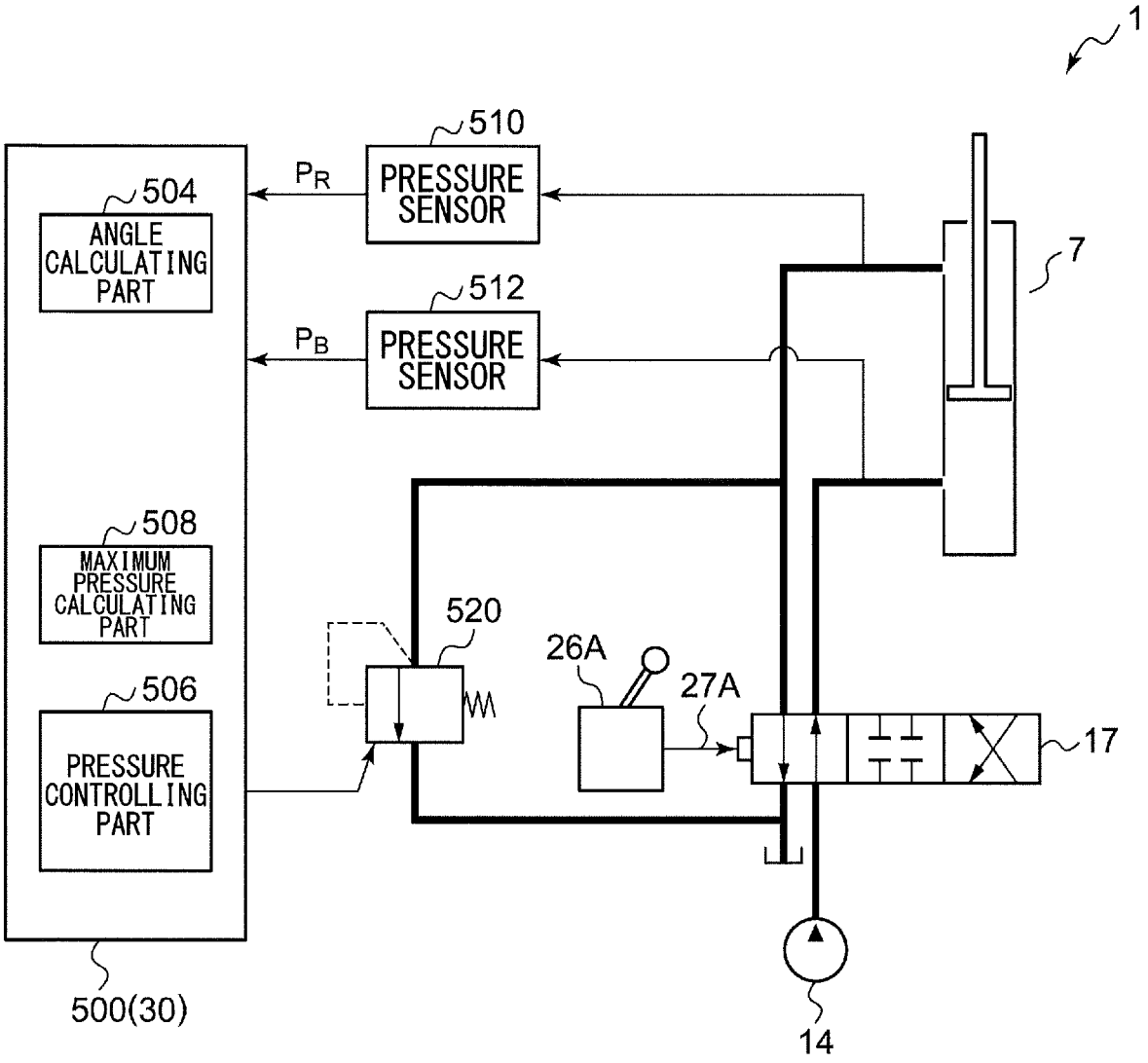
FIG. 6 is a block diagram illustrating the slip controlling part according to a second example configuration.

FIG. 6 is a block diagram illustrating the slip controlling part 500 according to a second example configuration. A relational expression (6) is obtained by transforming the expression (4) as follows:

$$F_1<\mu Mg/\sin \eta_1. \tag{6}$$

That is, $\mu Mg/\sin \eta_1$ is the maximum allowable value $F_{MAX}$ of the force $F_1$.

Furthermore, the rod pressure $P_R$ may also be expressed as a function $g(F_1, P_B)$ of the force $F_1$ and the bottom pressure $P_B$:

$$P_R=g(F_1,P_B). \tag{7}$$

Accordingly, it is possible to calculate a maximum value (maximum pressure) $P_{RMAX}$ that the rod pressure $P_R$ can take:

$$P_{RMAX}=g(F_{MAX},P_B). \tag{8}$$

A maximum pressure calculating part 508 calculates the maximum allowable pressure $P_{RMAX}$ of the rod pressure $P_R$ based on Eq. (8). The pressure controlling part 506 controls the solenoid proportional relief valve 520 such that the rod pressure $P_R$ detected by the pressure sensor 510 does not exceed the maximum pressure $P_{RMAX}$.

A person having ordinary skill in the art would appreciate that it is possible to so control the rod pressure $P_R$ as to satisfy the relational expression (4) in a manner other than as shown in FIGS. 5 and 6.

Third Example Configuration

Figure 7:
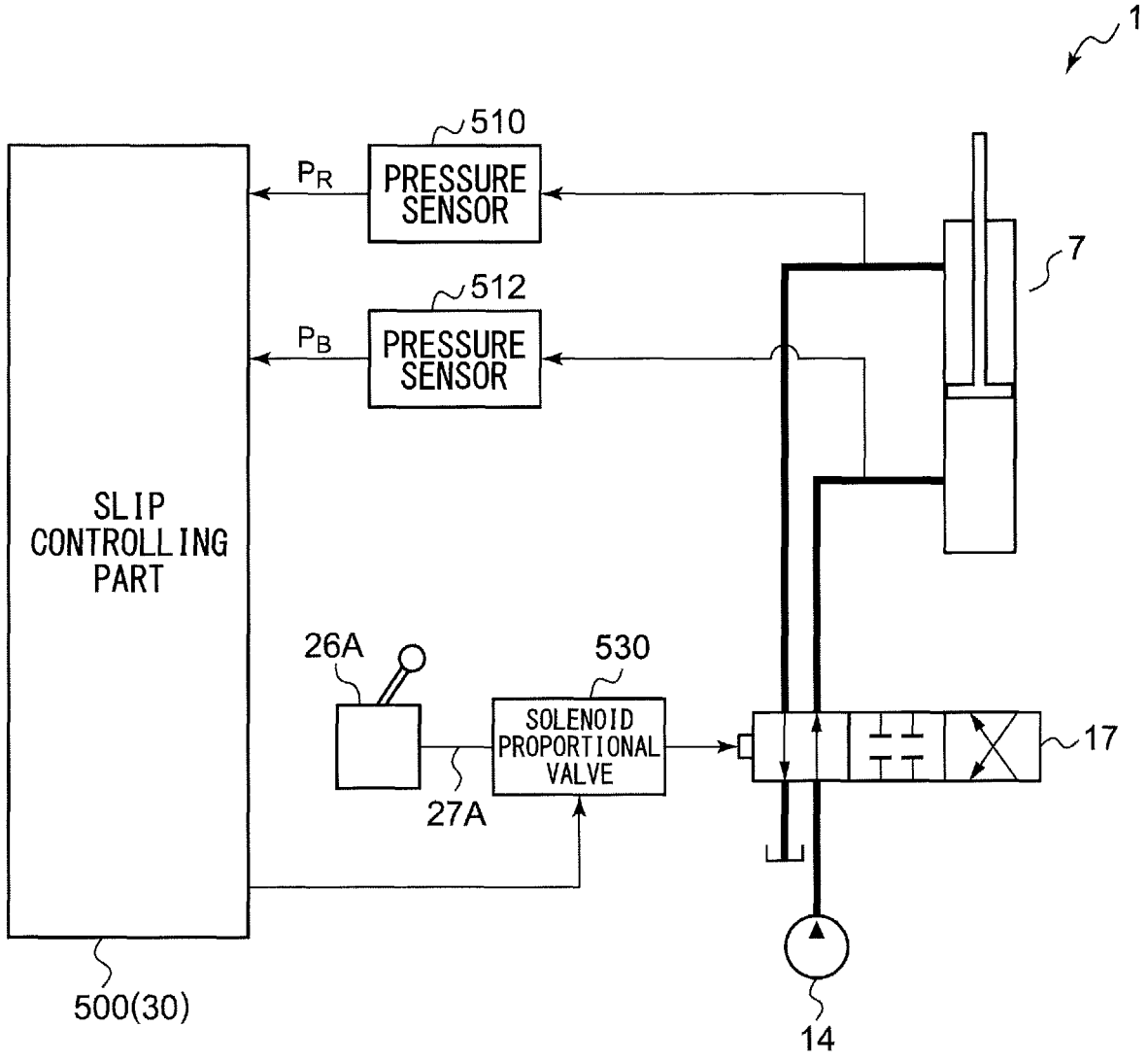
FIG. 7 is a block diagram of the slip controlling part of the shovel and its periphery according to a third example configuration.

FIG. 7 is a block diagram of the slip controlling part 500 of the shovel 1 and its periphery according to a third example configuration. The shovel 1 of FIG. 7 includes a solenoid proportional control valve 530 in place of the solenoid proportional relief valve 520 of the shovel 1 of FIG. 5. The solenoid proportional control valve 530 is provided in a pilot line 27A from the operating lever 26A to the control valve 17. The slip controlling part 500 varies a control signal to the solenoid proportional control valve 530 to vary a pressure to the control valve 17, thereby varying the bottom chamber side pressure and the pressure of the rod-side oil chamber of the boom cylinder 7, such that the expression (4) is satisfied.

The configuration and control system of the slip controlling part 500 of FIG. 7 are not limited, and the configuration and control system of FIG. 5 or 6 or other configurations and control systems may be adopted.

Fourth Example Configuration

The slip controlling part 500 may correct the motion of the boom cylinder 7 by reducing the output of the main pump 14, for example, setting a limit on horsepower or setting a limit on a flow rate.

Fifth Example Configuration

In the above description, the boom cylinder 7 is controlled to control a backward slip due to an arm opening motion, as a non-limiting example. Alternatively, to control a backward slip, the shovel 1 may control the pressure of the arm cylinder 8 in addition to or in place of the boom cylinder 7.

Figure 8:
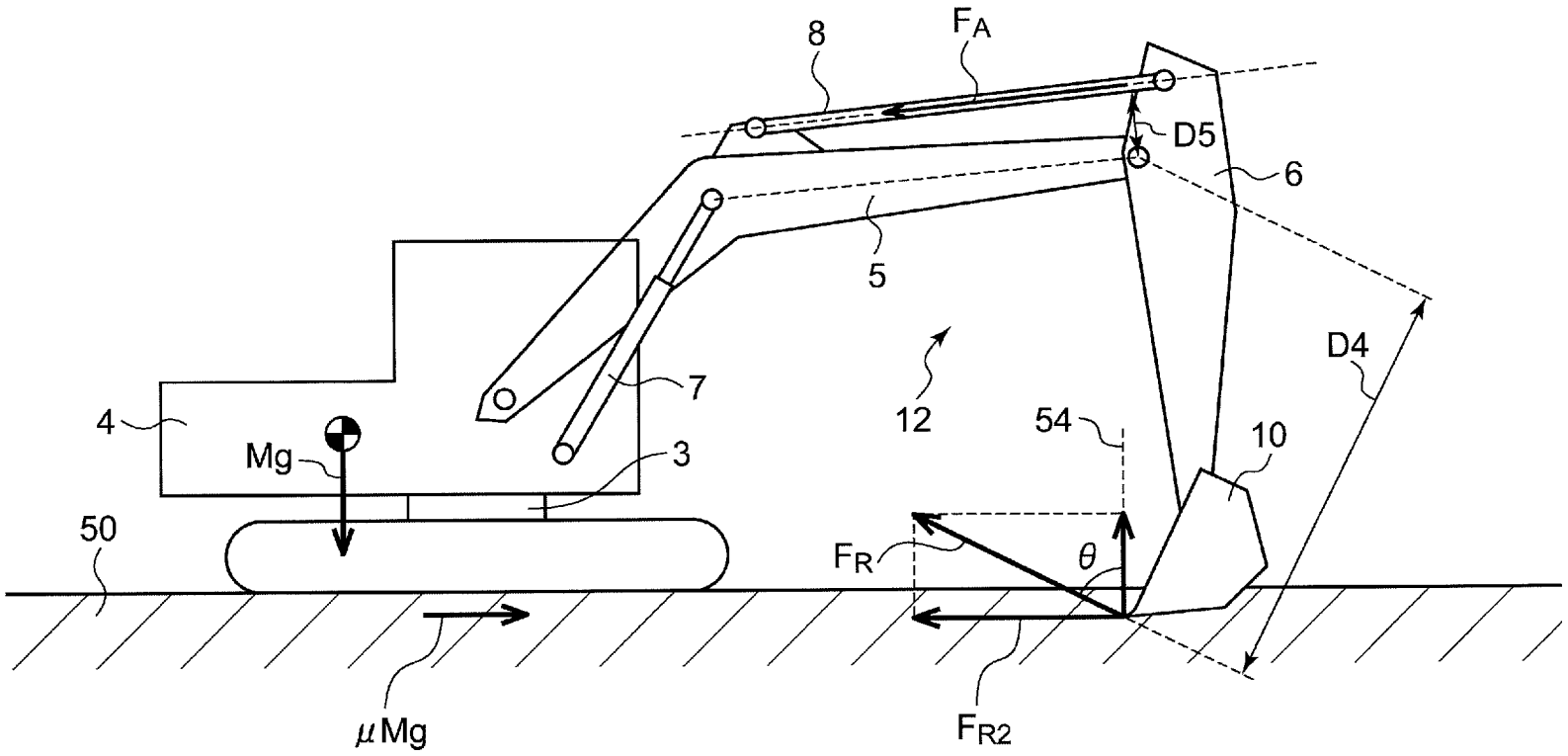
FIG. 8 is a diagram illustrating a mechanical model of a shovel regarding a backward slip.

FIG. 8 is a diagram illustrating a mechanical model of a shovel regarding a backward slip. During an arm opening motion, the arm cylinder 8 generates a force $F_A$ in a retracting direction. At this point, an excavation reaction force $F_R$ that the bucket 10 receives from the ground 50 is expressed by:

$$F_R=F_A \cdot D5/D4,$$

where D5 is the distance between the connecting point of the arm 6 and the boom 5 and a line passing through the arm cylinder 8, and D4 is the distance between the connecting point of the arm 6 and the boom 5 and a line including the vector of the excavation reaction force $F_R$.

Letting an angle formed by the vector of the excavation reaction force $F_R$ and the vertical axis 54 be θ, a force $F_{R2}$ to slip the vehicle body of the shovel backward by the excavation reaction force $F_R$ is given by:

$$F_R=F_R \times \sin\theta, \text{ and}$$

a condition under which no backward slip occurs is:

$$F_{R2}<\mu Mg.$$

Accordingly, the slip controlling part 500 corrects the motion of the arm cylinder 8 such that $$F_A \cdot D5/D4 \times \sin\theta<\mu Mg \quad (9) \text{ holds.}$$

Here, letting the pressure receiving area of a piston facing the bottom-side oil chamber of the arm cylinder 8 be $A_A$, the force $F_A$ is expressed by $F_A=P_A \cdot A_A$, where $P_A$ is the pressure of the hydraulic oil of the bottom-side oil chamber (the bottom pressure) of the arm cylinder 8. Accordingly, Inequality (10) is obtained as a condition under which no backward slip occurs:

$$P_A<\mu Mg \cdot D_4/(A_A D_5 \cdot \sin\theta). \quad (10)$$

That is, $\mu Mg \cdot D4/(A_A \cdot D5 \cdot \sin\theta)$ is the maximum allowable pressure $P_{MAX}$ of the bottom pressure $P_A$. The slip controlling part 500 monitors the bottom pressure $P_A$ of the arm cylinder 8, and corrects the motion of the arm cylinder 8 such that the bottom pressure $P_A$ does not exceed the maximum allowable pressure $P_{MAX}$.

Figure 9:
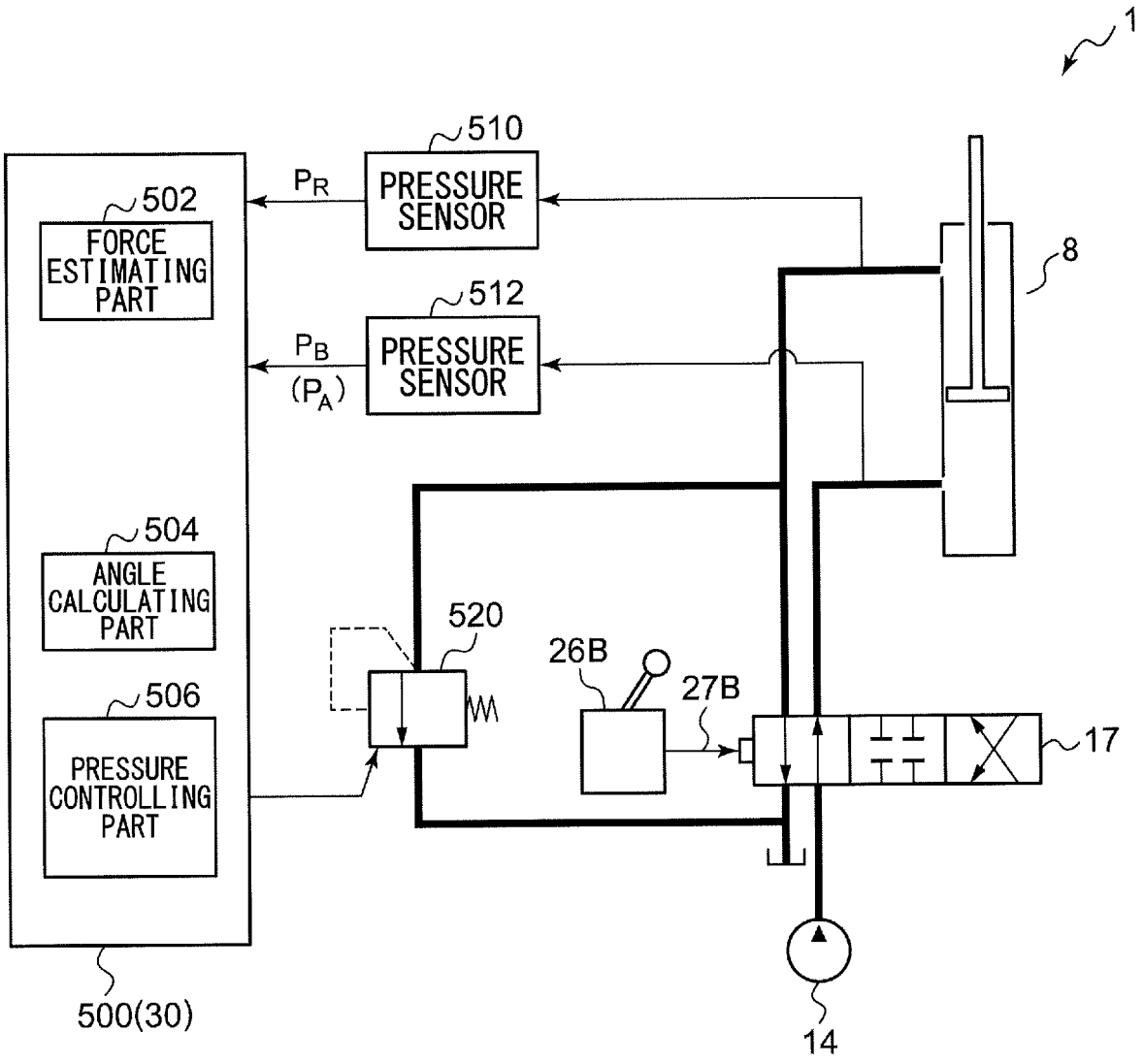
FIG. 9 is a block diagram of the slip controlling part of the shovel and its periphery according to a fifth example configuration.

FIG. 9 is a block diagram of the slip controlling part 500 of the shovel 1 and its periphery according to a fifth example configuration. The slip controlling part 500, whose control target is the arm cylinder 8, has the same basic configuration and operates the same as in FIG. 5. Specifically, the slip controlling part 500 controls a bottom pressure $P_B$ ($P_A$ in FIG. 8) of the arm cylinder 8 such that no backward slip occurs, specifically, Inequality (9) or (10) holds. According to this example configuration, the solenoid proportional relief valve 520 is provided between the bottom-side oil chamber of the arm cylinder 8 and a tank.

By controlling the solenoid proportional relief valve 520, the slip controlling part 500 controls the bottom pressure of the arm cylinder 8 to control a backward slip.

The configuration for controlling a backward slip by correcting the arm cylinder 8 is not limited to FIG. 9. For example, a mechanism for correcting the arm cylinder 8 may be configured using FIG. 6 or FIG. 7 as a basic configuration. Alternatively, as described in the fourth example configuration, the slip controlling part 500 may correct the motion of the arm cylinder 8 by reducing the output of the main pump 14, for example, setting a limit on horsepower or setting a limit on a flow rate.

Figure 10:
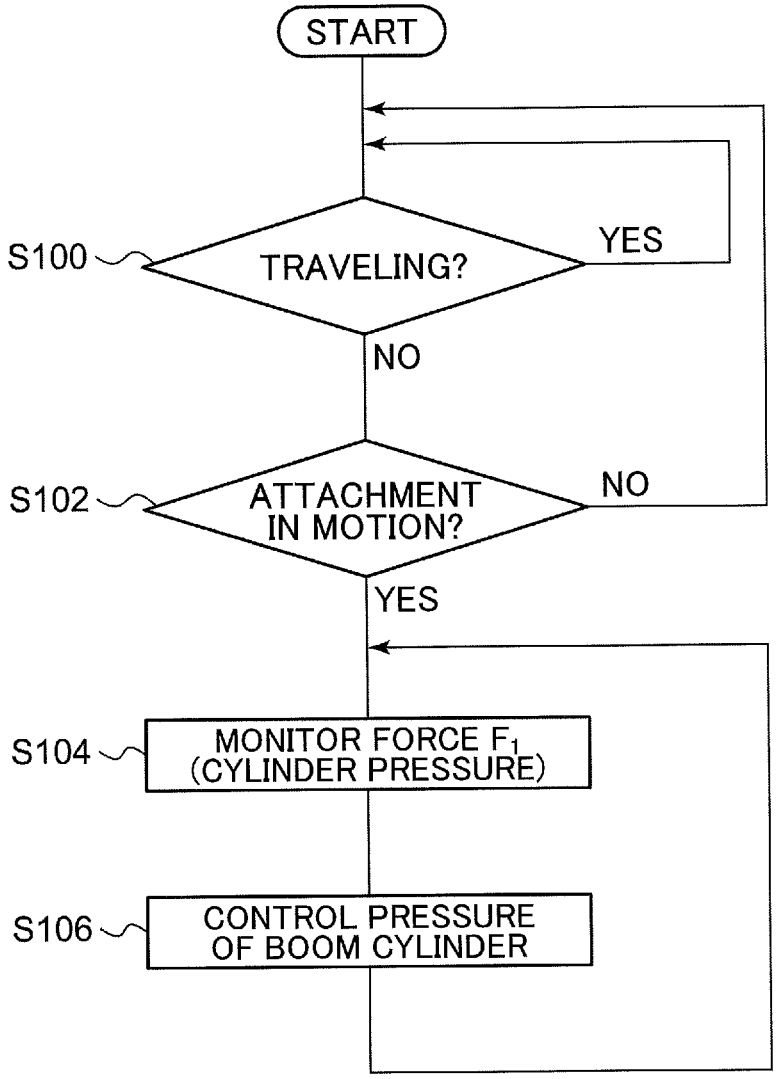
FIG. 10 is a flowchart of slip correction according to the embodiment.

FIG. 10 is a flowchart of slip correction according to the embodiment. First, it is determined whether the shovel 1 is traveling (S100). If the shovel is traveling (YES at S100), the flow returns again to the determination of S100. If the shovel 1 is not traveling and is stopped (NO at S100), it is determined whether the attachment 12 is in motion (S102). If the attachment 12 is not in motion (N at S102), the flow returns to step S100. If a motion of the attachment 12 is detected (YES at S102), a slip controlling process is enabled.

In the slip controlling process, the bottom pressure $P_B$ and the rod pressure $P_R$ of the boom cylinder 7 and the force $F_1$ that the boom 5 exerts on the vehicle body are monitored (S104). The pressure of the boom cylinder 7 is controlled such that no slip occurs, more specifically, such that the relational expression (4) is satisfied (S106).

The shovel 1 operates as described above. According to the shovel 1 of the embodiment, it is possible to control a backward slip of a shovel.

The present invention is described above based on an embodiment. A person having ordinary skill in the art would appreciate that the present invention is not limited to the above-described embodiment, that various design changes may be made, that various variations may be made, and that such variations are within the scope of the present invention. Such variations are described below.

[Variation 1]

Figure 11:
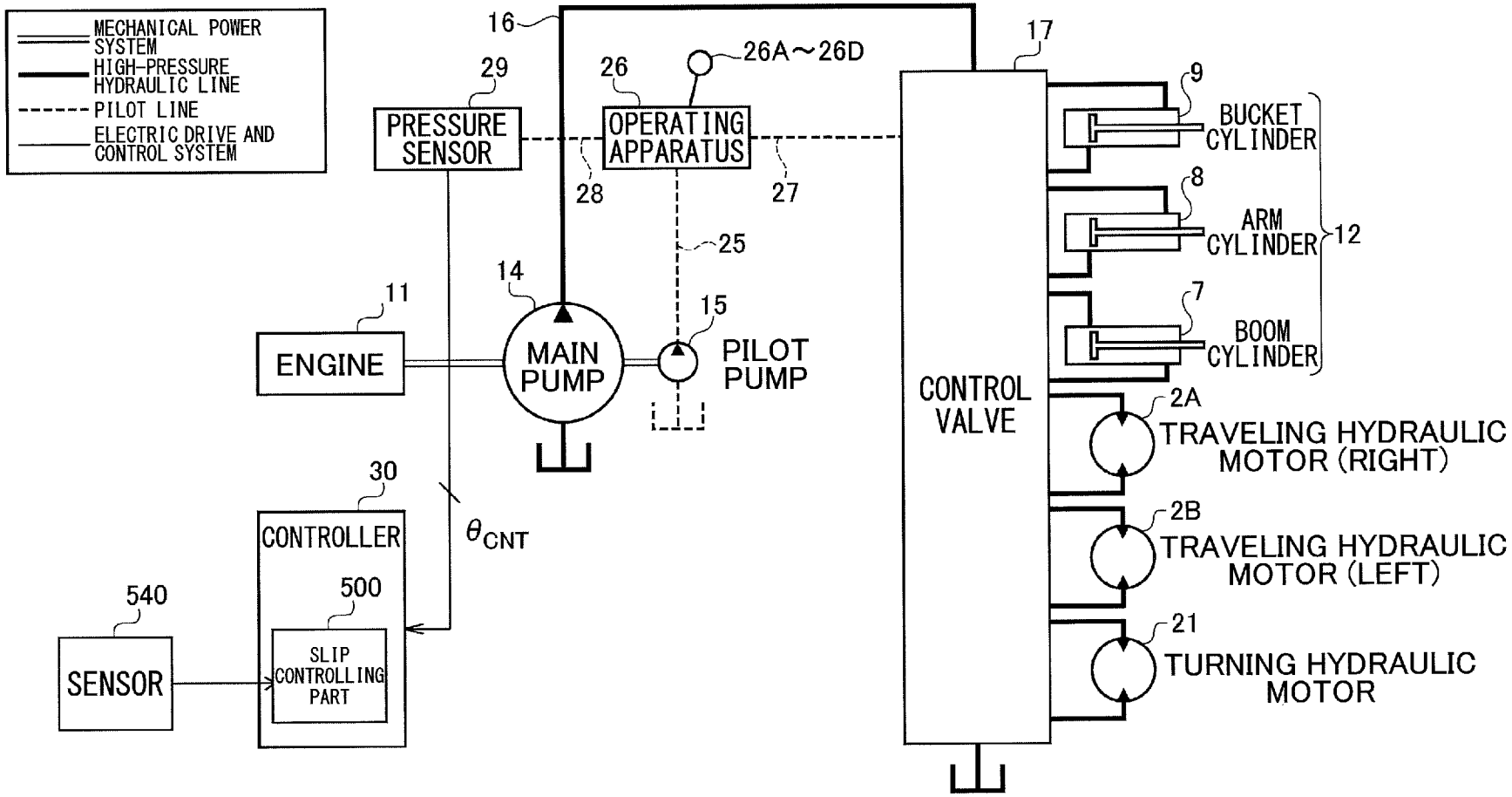
FIG. 11 is a block diagram of the electrical system and the hydraulic system of the shovel according to Variation 1.

A slip may be detected using a sensor, and the slip controlling process described in the embodiment may be executed when a slip occurs. FIG. 11 is a block diagram of the electrical system and the hydraulic system of the shovel 1 according to Variation 1. In addition to the shovel 1 of FIG. 3, the shovel 1 further includes a sensor 540.

The sensor 540 detects a motion of the body of the shovel 1. The sensor 540 is not limited to a particular type and configuration to the extent that the sensor 540 can detect a slip of the traveling body 2 of the shovel 1. Furthermore, the sensor 540 may be a combination of multiple sensors. The sensor 540 may preferably include an acceleration sensor and a velocity sensor provided on the upper turning body 4. The direction of the axis of detection of the acceleration sensor and the velocity sensor desirably coincides with the extension direction of the attachment 12.

The slip controlling part 500 detects a slip of the traveling body 2 in the extension direction of the attachment 12 based on the output of the sensor 540, and corrects the motion of the boom cylinder 7 of the attachment 12 in such a manner as to control the slip. The "detection of a slip" may be detection of actual slipping or detection of the sign of a slip.

In addition to a component attributed to a slip, a component attributed to vibration, a component attributed to turning, and a component attributed to disturbance can be included in the output of the sensor 540. The slip controlling part 500 may include a filter that extracts only a frequency component dominant in a slipping motion and remove other frequency components from the output of the sensor 540.

Figure 12A:
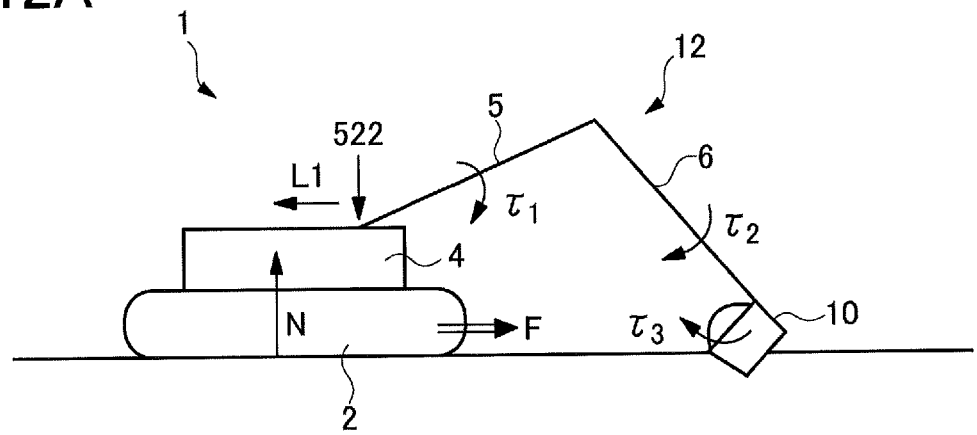
FIGS. 12A and 12B are diagrams illustrating a slip of the shovel due to the motion of an attachment.
Figure 12B:
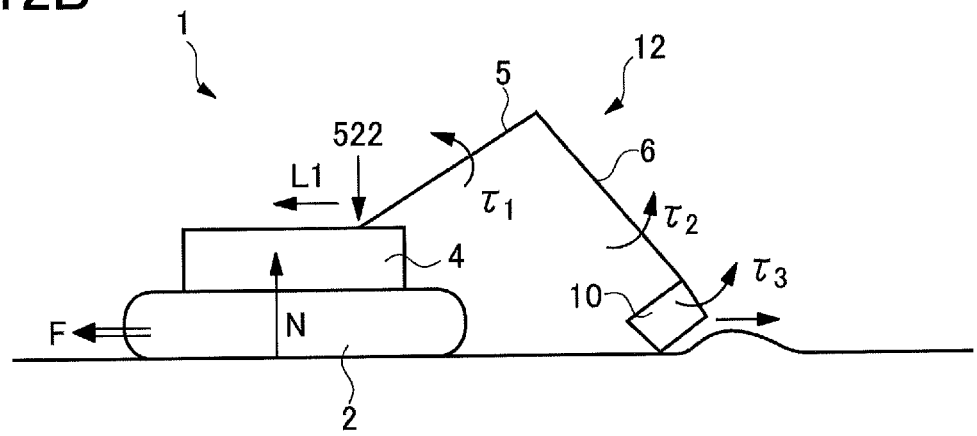
Figure 13A:
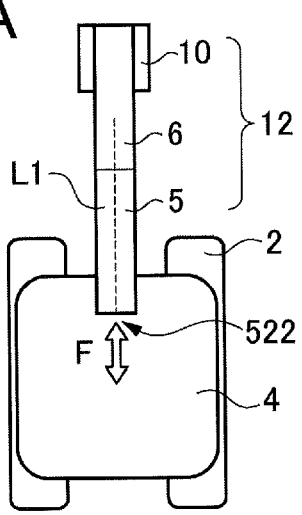
FIGS. 13A through 13D are diagrams illustrating a slip of the shovel.
Figure 13B:
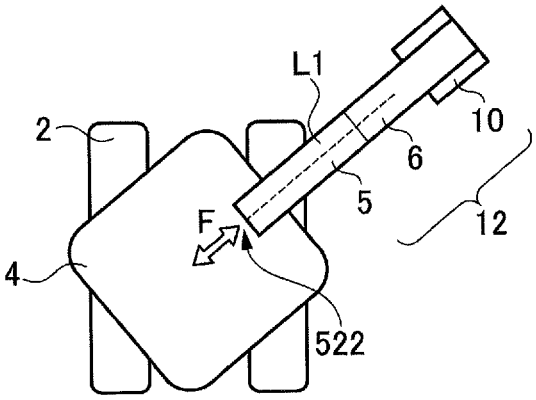
Figure 13C:
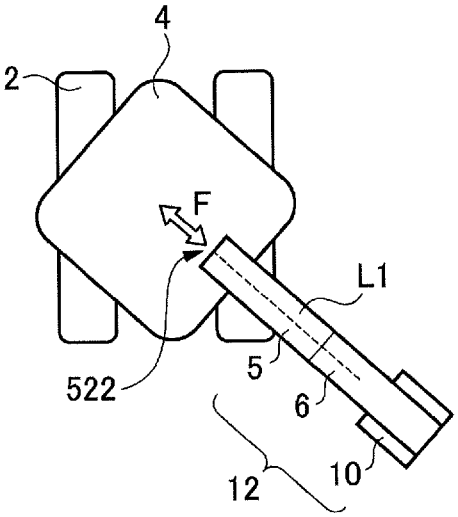
Figure 13D:
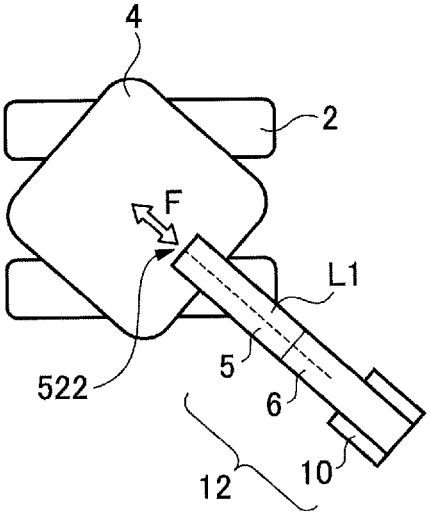

The basic configuration of the shovel 1 is as described above. Next, its operation is described. FIGS. 12A and 12B are diagrams illustrating a slip of the shovel 1 due to the motion of the attachment 12. FIGS. 12A and 12B are side views of the shovel 1. τ1 through τ3 denote torques (forces) generated at the respective links of the boom 5, the arm 6, and the bucket 10, respectively. FIG. 12A illustrates excavation work, where a force F that the attachment 12 exerts on the body (the traveling body 2 and the upper turning body 4) of the shovel 1 acts on a base 522 of the boom 5, and this force F acts in a direction to move the traveling body 2 toward the bucket 10. Letting a coefficient of static friction between the traveling body 2 and the ground be μ and letting a normal force to the traveling body 2 be N, the traveling body 2 starts to slip in the direction of the force F when $F>\mu N$ is satisfied.

FIG. 12B illustrates leveling work, where the force F that the attachment 12 exerts on the body of the shovel 1 acts in a direction to move the traveling body 2 away from the bucket 10. In this case as well, the traveling body 2 starts to slip in the direction of the force F when F>μN is satisfied.

FIGS. 13A through 13D are diagrams illustrating a slip of the shovel 1. FIGS. 13A through 13D are top plan views of the shovel 1. The boom 5, the arm 6, and the bucket 10 of the attachment 12 are always positioned in the same plane (a sagittal plane) irrespective of their posture and work contents. Accordingly, it can be said that while the attachment 12 is in motion, a reaction force F from the attachment 12 acts on the body (the traveling body 2 and the upper turning body 4) of the shovel 1 in an extension direction L1 of the attachment 12. This does not depend on the positional relationship (the turning angle) between the traveling body 2 and the upper turning body 4, either. As illustrated in FIGS. 12A and 12B, the direction of the force F differs depending on the contents of work. In other words, during the occurrence of a slip in the extension direction L1 of the attachment 12, the slip is presumed to be caused by the motion of the attachment 12, and accordingly, the slip can be controlled by controlling the attachment 12.

Figure 14:
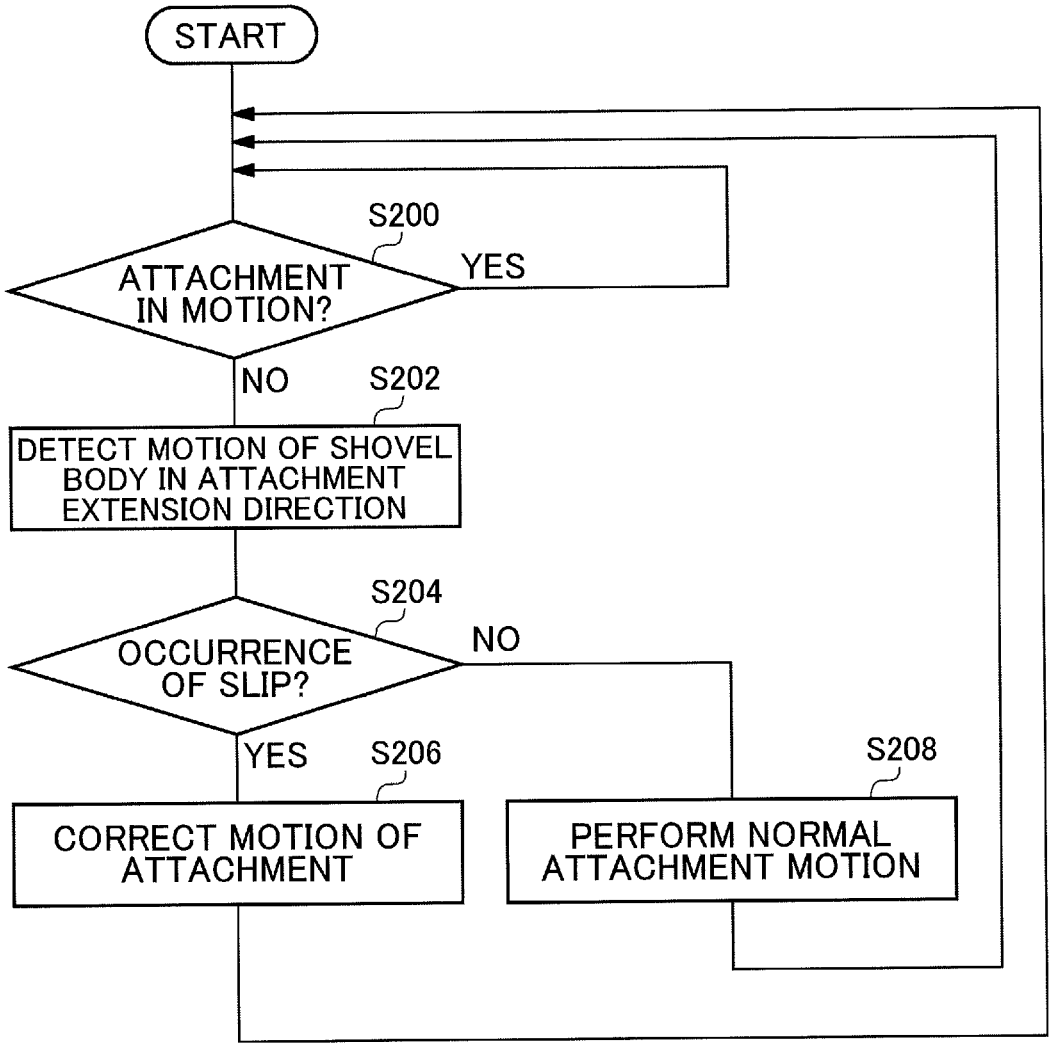
FIG. 14 is a flowchart of slip correction according to the embodiment.

FIG. 14 is a flowchart of slip correction according to the embodiment. First, it is determined whether the attachment 12 is in motion (S200). If the attachment 12 is not in motion (N at S200), the flow returns to step S200. If a motion of the attachment 12 is detected (YES at S200), a motion (for example, acceleration) of the shovel body in the attachment extension direction L1 is detected (S202). If no slip is detected (NO at S204), a normal attachment motion based on the operator's input is performed (S208). If a slip is detected (YES at S204), the motion of the attachment 12 is corrected (S206).

According to the shovel 1 of Variation 1, it is possible to control a slip by detecting a slip due to the motion of the attachment 12 with the sensor 540 and correcting the motion of the attachment 12 in accordance with the result.

In addition to a slip due to the excavation reaction force of the attachment 12, an intentional displacement of the traveling body 2 and a slip due to the turning of the turning body 4 cause the displacement of the traveling body 2. The correction of the motion of the attachment 12 is most effective when a slip is caused by an excavation reaction force, and may increase a slip or displacement when the slip or displacement is due to other causes. Therefore, to be more specific, the motion of the attachment 12 may be corrected when the traveling body 2 is displaced during excavation work with the attachment 12.

Accordingly, in the case where it is possible to determine that traveling or turning is being performed, even when a slip occurs, the slip can be determined as not being caused by the attachment 12 and serve as information for making a determination as to control. To put it the other way around, it is possible to accurately control a slip due to an excavating motion during excavation of earth and sand with the attachment 12 by determining that the slip is caused by the motion of the attachment 12 further in view of the information for making a determination, namely, that neither traveling nor turning is being performed.

According to Variation 1, the motion of the attachment 12 is corrected and a slip is controlled on condition that the position of the traveling body 2 is changed during excavation with the attachment 12. Furthermore, it is possible to accurately control a slip due to an excavating motion by correcting the motion of the attachment 12 by further considering, as information for making a determination as to correction at this point, the operating information of an operating lever of the attachment 12, the traveling body 2, and turning, and an actual motion.

As illustrated in FIGS. 13A through 13D, the extension direction L1 of the attachment 12 always coincides with the orientation (the front direction) of the upper turning body 4. Accordingly, by mounting the sensor 540 (acceleration sensor) not on the traveling body 2 side on which an actual slip occurs but on the upper turning body 4, it is possible to directly and accurately detect a slip motion in the extension direction L1, independent of the turning angle (the position) of the upper turning body 4.

It is theoretically possible to control a slip with correction of the motion of the attachment 12 being transparent to the operator by performing the correction at high speed. If a response delay increases, however, the operator may feel a gap between the operator's own operation and the motion of the attachment 12. Therefore, the shovel 1 may notify the operator of and alert the operator to the occurrence of a slip in parallel with correction of the motion of the attachment 12 when a slip is detected. The controller 30 may perform this notification and alert using aural means such as an audio message and an alarm sound, visual means such as display and warning light, and tactile (physical) means such as vibrations.

This makes it possible for the operator to recognize that the gap between the operation and the motion is attributed to automatic correction of the motion of the attachment 12. Furthermore, when this notification occurs in succession, the operator can recognize the improperness of the operator's own operation, and the operation is assisted.

Figure 15A:
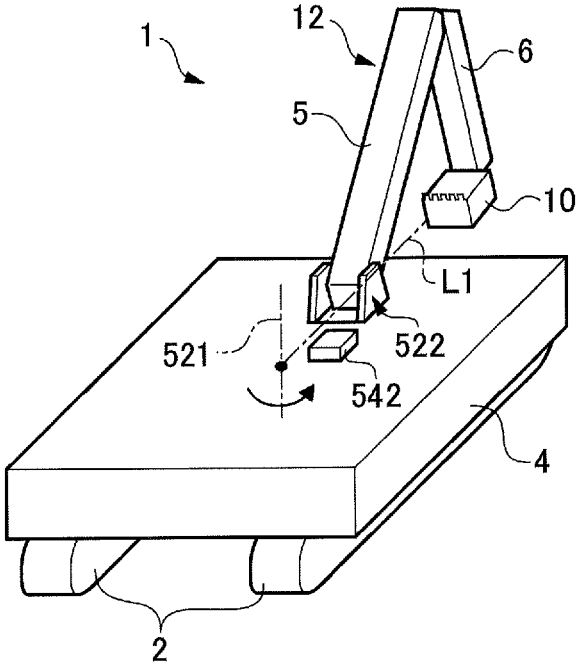
FIGS. 15A and 15B are diagrams illustrating an attachment location of a sensor.
Figure 15B:
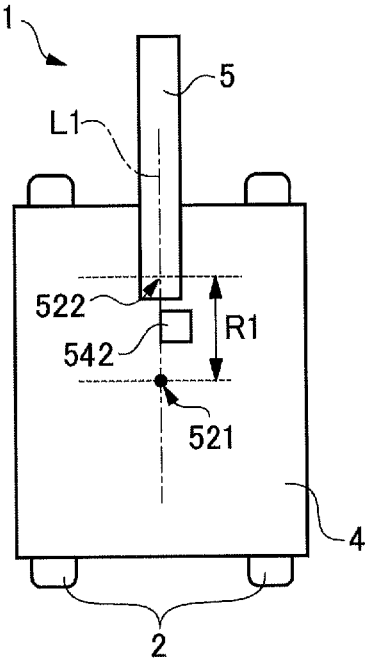

FIGS. 15A and 15B are diagrams illustrating an attachment location of the sensor 540. As described above, the sensor 540 includes an acceleration sensor 542 provided on the upper turning body 4. The acceleration sensor 542 has an axis of detection in the extension direction L1. Here, the point of application of a force that the attachment 12 exerts on the upper turning body 4 is the base 522 of the boom 5. Accordingly, it is desirable to provide the acceleration sensor 542 at the base 522 of the boom 5. This makes it possible to suitably detect a slip caused by the motion of the attachment 12.

When the acceleration sensor 542 is distant from a turning axis 521, the acceleration sensor 542 is affected by a centrifugal force due to a turning motion when the turning body 4 makes a turning motion. Therefore, it is desirable to place the acceleration sensor 542 near the base 522 of the boom 5 and near the turning axis 521. To put it together, it is desirable to place the acceleration sensor 542 in an area R1 between the base 522 of the boom 5 and the turning axis 521 of the upper turning body 4. This makes it possible to reduce the influence of a turning motion included in the output of the acceleration sensor 542 and to suitably detect a slip caused by the motion of the attachment 12.

When the position of the acceleration sensor 542 is too distant from the ground, the output of the acceleration sensor 542 includes acceleration components due to pitching and rolling, which is not preferable. In this light, it is preferable to install the acceleration sensor 542 as low as possible on the upper turning body 4.

[Variation 2]

Figure 16A:
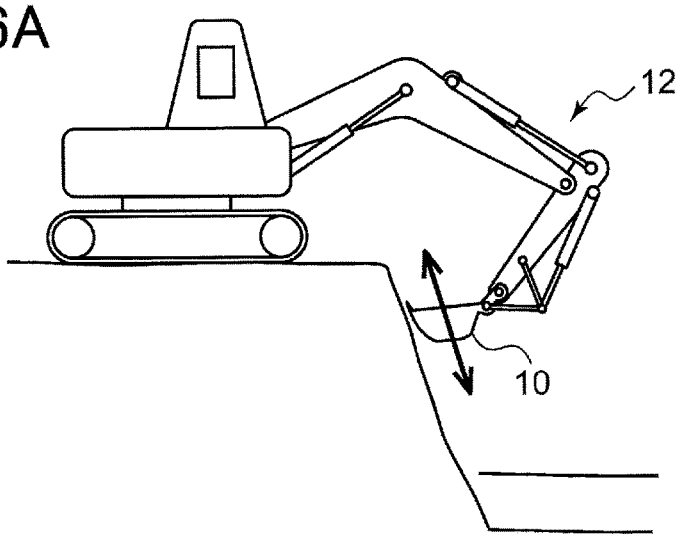
FIGS. 16A through 16C are diagrams illustrating other examples of backward slips.
Figure 16B:
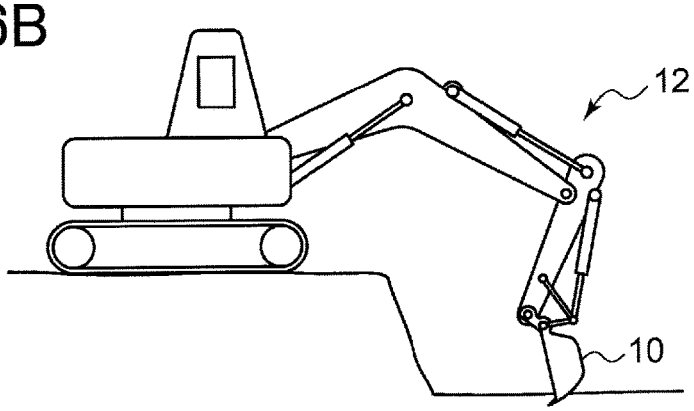
Figure 16C:
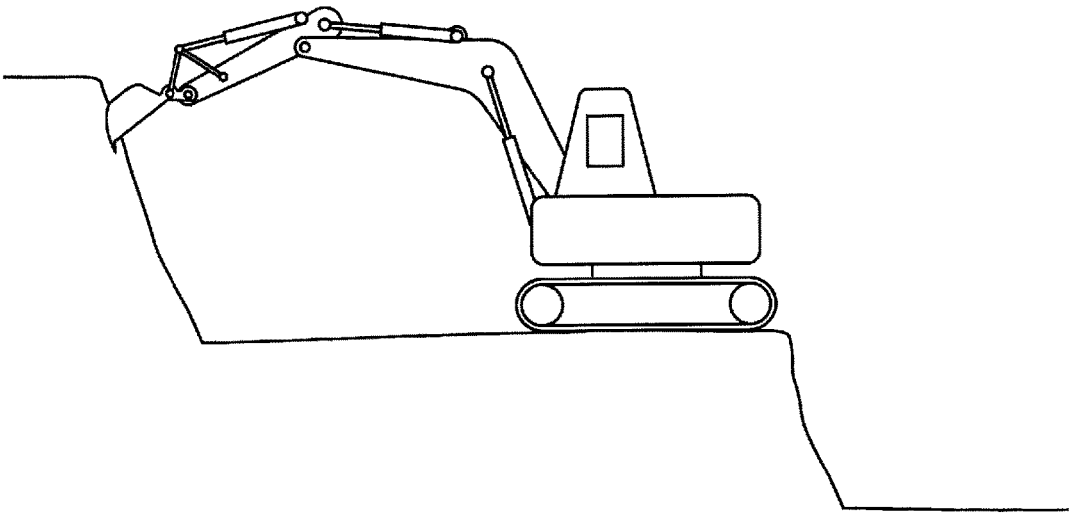

While a backward slip due to an arm operation is described with reference to FIGS. 2A and 2B, the application of the present invention is not limited to this. FIGS. 16A through 16C are diagrams illustrating other examples of backward slips. FIG. 16A illustrates slope finishing work. According to this work, the bucket 10 is moved along a slope. If a force that is not along the slope is generated because of a wrong operation, however, the vehicle body is dragged forward.

FIG. 16B illustrates deep digging work. When the attachment 12 is driven with the bucket 10 being caught on a hard ground, the shovel 1 is dragged forward.

FIG. 16C illustrates cliff excavating work. If a strong force is generated with the bucket 10 being caught on a cliff, earth and sand may collapse at a stretch. In this case, the reaction of the attachment is transmitted to the vehicle body because of a balance force immediately before the collapse, thereby inducing a backward slip of the vehicle body.

Thus, the present invention is effective for slips that occur during various kinds of work.

[Variation 3]

Figure 17:
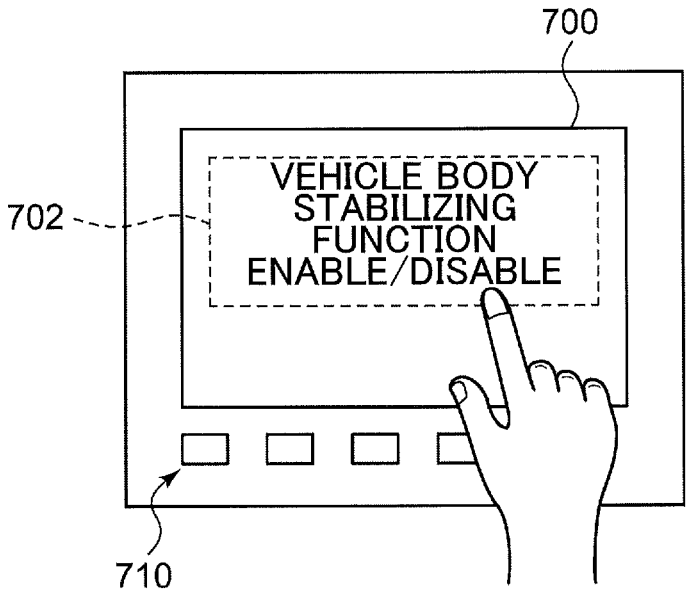
FIG. 17 is a diagram illustrating a display and an operation part provided in the cab of the shovel.

The operation may desire to intentionally use a slip of the vehicle body. Therefore, the operator may turn on and off a slip controlling function. FIG. 17 is a diagram illustrating a display 700 and an operation part 710 provided in the cab 4*a* of the shovel 1. For example, a dialog 702 or icon asking the operator whether to turn on or off (enable or disable) the slip controlling function is displayed on the display 700. The operator determines whether to enable or disable the slip controlling function using the operation part 710. The operation part 710 may be a touchscreen, and the operator may specify enabling or disabling by touching an appropriate part of the display.

Figure 18B:
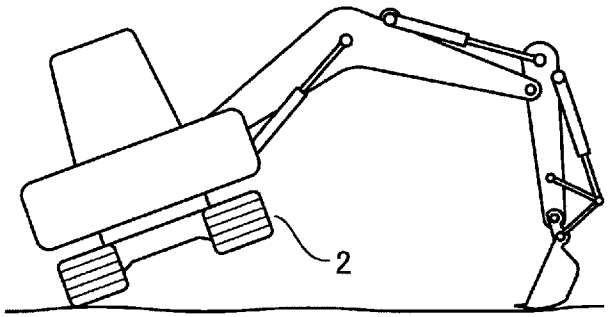
FIGS. 18A and 18B are diagrams illustrating situations where a slip controlling function is to be disabled.
Figure 18A:
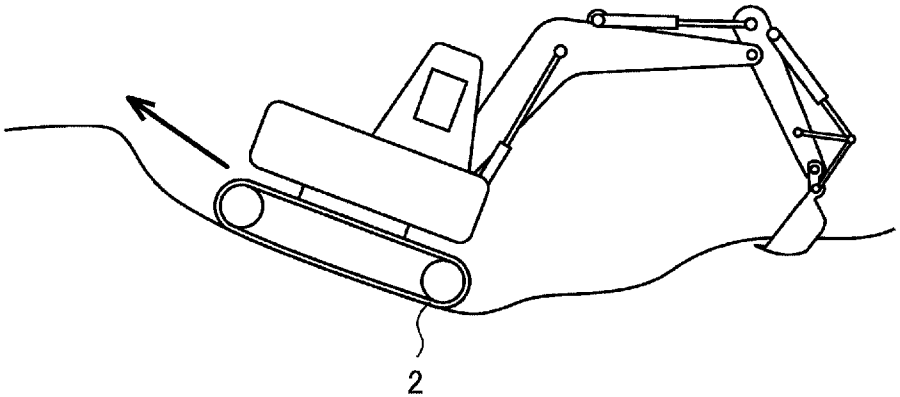

FIGS. 18A and 18B are diagrams illustrating situations where the slip controlling function is to be disabled. FIG. 18A is the case where the traveling body 2 is stuck in a deep part and tries to get out of it. When propulsion by the traveling body 2 is not suitably obtained, it is possible to get out of a deep part by operating the attachment 12 to positively slip the traveling body 2.

FIG. 18B is the case where it is desired to remove mud from a crawler (caterpillar) of the traveling body 2. By lifting and idling a crawler on one side using the attachment 12, it is possible to remove mud from the crawler. In this case as well, the slip controlling function is to be disabled.

[Variation 4]

According to the embodiment, a slip is controlled by controlling the pressure of the boom cylinder 7, while the pressures of the arm cylinder and the bucket cylinder may be additionally controlled.

Furthermore, while controlling a backward slip is described in the embodiment, the same technique may also be applied to a forward slip of the vehicle body, and such an embodiment as well is included in the scope of the present invention.

According to an aspect of the present invention, a shovel includes a traveling body, an upper turning body turnably provided on the traveling body, an attachment including a boom, an arm, and a bucket and attached to the upper turning body, and a slip controlling part configured to correct the motion of the attachment in such a manner as to control a slip of the traveling body toward the back in the extension direction of the attachment.

According to this embodiment, it is possible to increase safety by controlling a backward slip.

The slip controlling part may correct the motion of the boom cylinder of the attachment based on a force exerted on the upper turning body by the boom cylinder.

The slip controlling part may correct the motion of the boom cylinder based on the rod pressure and the bottom pressure of the boom cylinder.

The slip controlling part may control the rod pressure of the boom cylinder. For example, it is possible to control a backward slip by providing a relief valve on the rod side of the boom cylinder to prevent the rod pressure from becoming too high. Alternatively, the rod pressure may be prevented from becoming too high by providing a solenoid control valve in a pilot line to a control valve of the boom cylinder to control a pilot pressure.

The slip controlling part may correct the motion of the boom cylinder such that $F_1 \sin \eta_1 < \mu Mg$ holds, where $\eta_1$ is an angle formed by the boom cylinder and a vertical axis, $F_1$ is the force exerted on the upper turning body by the boom cylinder, $\mu$ is a coefficient of static friction, M is the weight of a vehicle body, and g is gravitational acceleration.

The slip controlling part may control a backward slip by controlling $F_1$ such that $F_1 < \mu Mg/\sin \eta_1$ holds, letting $\mu Mg/\sin \eta_1$ be the maximum allowable value $F_{MAX}$ of the force $F_1$.

Here, $F_1$ may be calculated based on the rod pressure $P_R$ and the bottom pressure $P_B$ of the boom cylinder.

Alternatively, the backward slip may be controlled by calculating the maximum value $P_{RMAX}$ of the rod pressure $P_R$ and controlling the rod pressure $P_R$ such that $P_R < P_{RMAX}$ holds.

Another embodiment of the present invention as well is directed to a shovel. This shovel includes a traveling body, an upper turning body turnably provided on the traveling body, an attachment including a boom, an arm, and a bucket and attached to the upper turning body, and a slip controlling part configured to correct the motion of the attachment such that $F_1 \sin \eta_1 < \mu Mg$ holds, where $\eta_1$ is an angle formed by the boom cylinder of the attachment and a vertical axis, $F_1$ is a force exerted on the upper turning body by the boom cylinder, $\mu$ is a coefficient of static friction, M is the weight of a vehicle body, and g is gravitational acceleration.

According to this embodiment, it is possible to control a slip of the traveling body.

Any combinations of the above-described constituent elements and a method, an apparatus, and a system among which constituent elements and expressions of the present invention are interchanged are also valid as embodiments of the present invention.

The present invention is described using specific terms based on an embodiment. The embodiment, however, merely illustrates the principle and applications of the present invention, and many variations and replacements may be made with respect to the embodiment without departing from the idea of the present invention defined in the claims.

Embodiments of the present invention are applicable to industrial machines.

What is claimed is:

1. A shovel comprising:

a traveling body;

an upper turning body turnably provided on the traveling body, an attachment including a boom, an arm, and a bucket and attached to the upper turning body; and a processor configured to correct a motion of the attachment such that $F_1 \sin \eta_1 < \mu Mg$ holds, where $\eta_1$ is an angle formed by a boom cylinder of the attachment and a vertical axis, $F_1$ is a force exerted on the upper turning body by the boom cylinder, $\mu$ is a coefficient of static friction, M is a weight of a vehicle body of the shovel, and g is gravitational acceleration.

2. The shovel as claimed in claim 1, further comprising:

a sensor configured to detect a motion of the traveling body, wherein the processor is configured to correct the motion of the attachment in response to detection of a slip of the traveling body or a sign thereof based on an output of the sensor.

3. The shovel as claimed in claim 1, wherein the processor is configured to be disabled from correcting the motion of the attachment such that $F_1 \sin \eta_1 < \mu Mg$ holds, based on an input of an operator.

4. The shovel as claimed in claim 1, wherein the processor is further configured to notify an operator of and alert the operator to an occurrence of a slip of the traveling body.

5. The shovel as claimed in claim 1, wherein the processor is configured to correct a motion of the boom cylinder.

6. The shovel as claimed in claim 2, wherein the processor is configured to correct the motion of the boom cylinder based on a rod pressure and a bottom pressure of the boom cylinder.

7. The shovel as claimed in claim 1, wherein the processor is further configured to control a rod pressure of the boom cylinder.

8. The shovel as claimed in claim 1, wherein the processor is further configured to correct a motion of an arm cylinder of the attachment.

9. The shovel as claimed in claim 8, wherein the processor is configured to correct the motion of the arm cylinder in such a manner as to prevent a bottom pressure of the arm cylinder from exceeding a maximum allowable value.

* * * * *